US007654327B1

(12) United States Patent
Shivers, III et al.

(10) Patent No.: US 7,654,327 B1
(45) Date of Patent: Feb. 2, 2010

(54) TENSIONER ASSEMBLY

(75) Inventors: Robert Magee Shivers, III, Houston, TX (US); David Trent, Cypress, TX (US); Daniel H. Longwell, Jr., Houston, TX (US)

(73) Assignee: ATP Oil & Gas Corporation, Houston, TX (US)

( * ) Notice: Subject to any disclaimer, the term of this patent is extended or adjusted under 35 U.S.C. 154(b) by 0 days.

(21) Appl. No.: 12/203,002

(22) Filed: Sep. 2, 2008

(51) Int. Cl.
*E21B 7/12* (2006.01)

(52) U.S. Cl. ..... 166/345; 166/359; 405/224.4; 405/223.1

(58) Field of Classification Search ..... 166/345, 166/350, 359, 367; 405/223.1, 224.4
See application file for complete search history.

(56) References Cited

U.S. PATENT DOCUMENTS 7,144,048 B2 * 12/2006 Humphreys ..... 285/290.3
2008/0304916 A1 * 12/2008 Crotwell et al. ..... 405/224.2

* cited by examiner

*Primary Examiner*—William P Neuder
(74) *Attorney, Agent, or Firm*—Buskop Law Group, PC; Wendy Buskop

(57) ABSTRACT

A tensioner assembly for moveably carrying a conductor that communicates from a wellhead to a piece of well access equipment on a rig. The tensioner assembly includes a support frame, at least one hydraulic cylinder connected to the support frame, and at least one primary accumulator in fluid communication with the hydraulic cylinder.

20 Claims, 6 Drawing Sheets

TENSIONER ASSEMBLY

FIELD

The present embodiments relate to a tensioner assembly for supporting top tension drilling and production risers on a floating vessel.

BACKGROUND

A need exists for a tensioner assembly that eliminates the need for riser centralizers or stabilization between a tension ring and well head equipment when the tensioner stroke range is large. A need exists for tensioner assembly that achieves stabilization by compensating a conductor, which transfers tension from the cylinders to the riser.

A need further exists for a conductor that can protect the riser from impact with a vessel, and which can provide shelter from wave loading in a wave zone.

The present embodiments meet these needs.

BRIEF DESCRIPTION OF THE DRAWINGS

The detailed description will be better understood in conjunction with the accompanying drawings as follows.

Figure 1:
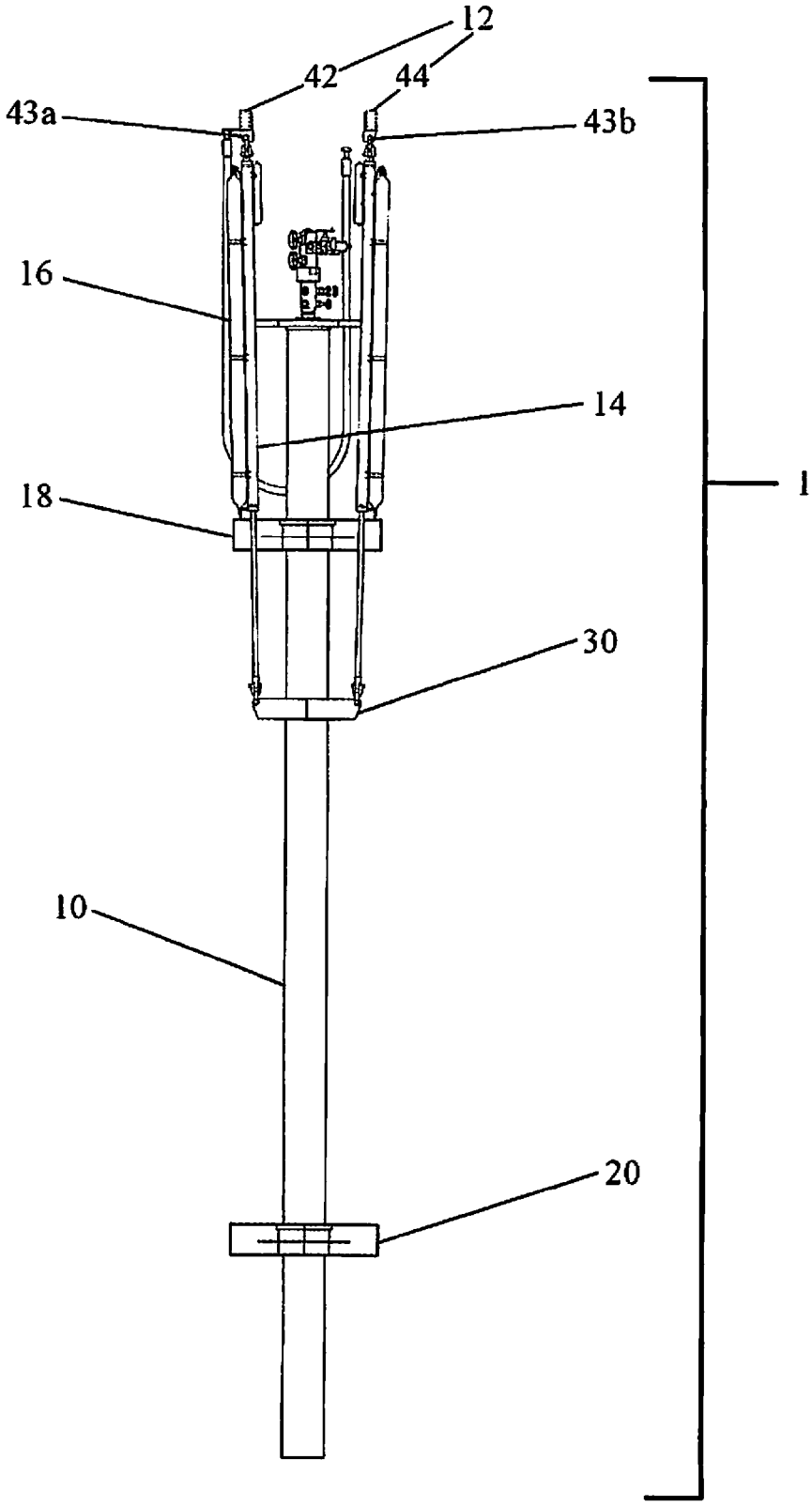
FIG. 1 depicts front view of the tensioner assembly.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The embodiments generally relate to a tensioner assembly. The embodiments can provide stabilization of a riser and reduce the equipment needed to stabilize the riser. This can reduce costs associated with riser systems, and enhances the safety of the riser system.

The embodiments can further relate to a tensioner assembly for moveably carrying a conductor that can communicate from a wellhead to a piece of well access equipment on a rig.

The tensioner can have a support frame. The support frame can have at least one hydraulic cylinder connected to the support frame. In an embodiment there can be up to eight cylinders. The hydraulic cylinders can have a pressure from about 100 psi to about 3500 psi, and can provide a load from about 200 kips to about 2500 kips. It is contemplated that the number of cylinders can exceed 8 if the specific task requires.

The support frame can include a first beam. The first beam can have at least one pad eye. The first beam is parallel to the second beam that can have at least one pad eye. The pad eyes can be used to support the at least one hydraulic cylinder. The first beam and the second beam can be connected to the rig.

The pad eyes can have a diameter for receiving a shackle to hold the hydraulic cylinders. The pad eyes can be disposed on the beams or they can be integral with the deck of a vessel.

The first beam and the second beam can be a steel I-beam, a steel C-beam, tubulars, or a similar structural beam.

In another embodiment the support frame can be a cassette frame. A cassette frame can be square, octagon, hexagon shaped and sized to fit within a well bay.

The tensioner can also have at least one primary accumulator. The primary accumulator can be in fluid communication with the hydraulic cylinder. The primary accumulator can be either directly connected to the hydraulic cylinder or can be in a remote location and connected by a conduit, an umbilical, or a jumper to the hydraulic cylinder. The primary accumulator can have a capacity of at least 1 gallon. The primary accumulator capacity can exceed 470 gallons.

The conductor can slidabley engage an upper conductor guide and a lower conductor guide. The upper and lower conductor guides can each have a guide frame for supporting a conductor guide wear pad using a conductor guide retaining ring.

The upper conductor guide and the lower conductor guide can have different dimensions. The upper conductor guide and the lower conductor guide can be made from metal, composite, or similar structural material. The composite can be a glass composite, a ceramic composite, a polymer composite, or similar well known composites. The lower conductor guide can be made from the same or different material as the upper conductor guide.

The conductor guide frame can be metal, composite, or similar structural material. The conductor guide frame supports conductor guide wear pads using a conductor guide retaining ring. The conductor guide retaining ring can be metal, composite, or any structural material. The conductor guide ring can be attached to the conductor guide frame by bolting, welding, or similar mechanical means. The conductor guide ring can be a complete ring or a segment of a ring.

The conductor guide wear pad can be made from an ultra high molecular weight polymer. The ultra high molecular weight polymer can be polypropylene, polyethylene, polybutylene, homopolymer, and copolymers thereof. The conductor wear pads can also be metal or any bearing material. The conductor guide wear pad can be a composite including ceramic composite or a glass composite.

A tension frame can be secured to the conductor between the upper and the lower conductor guides for transferring tension from the at least one hydraulic cylinder to the conductor and the riser. The tension frame can be made from steel and can have a square, round, or rectangular shape. The tension frame can transfer tension from the hydraulic cylinder to the conductor. The tension frame can be removable secured to the conductor. An example of how the tension frame can be removably connected to the conductor includes bolts or other similar mechanical means.

The hydraulic cylinder can be secured to the tension frame by the use of a shackle, or another pin connection.

The well access equipment can include a production tree, a blow out preventer, or similar commonly used equipment. The well access equipment can be connected to the riser.

A tension ring assembly can be disposed on the conductor above the upper conductor guide. The tension ring assembly can be a tapered bowl tension ring assembly.

The tapered bowl tension ring assembly can include a tension disc having a tapered center. Tapered collets can engage the tension disc and a collet support ring can be disposed on the tapered collets to hold the collets together. The collet support ring can be steel or another structural and stiff member. The tapered collets engage the riser and are held together by the collet support ring.

The collet support ring is secured to the tension disc. The tension disc can have an outer diameter segment that engages the conductor with a thickness that is about 50 percent to about 70 percent the thickness of the inner diameter segment of the tension disc. The tension disc engages the collets that engage the riser. The tension disc can be made from metal and can have a diameter ranging from about 28 inches to about 63 inches.

In another embodiment the tension ring assembly can include a single tension disc directly engaging the conductor, and supporting the riser.

In an alternative embodiment the tension disc can be a solid segment with perforations.

The embodiments of the invention can be best understood with reference to the Figures.

Figure 2:
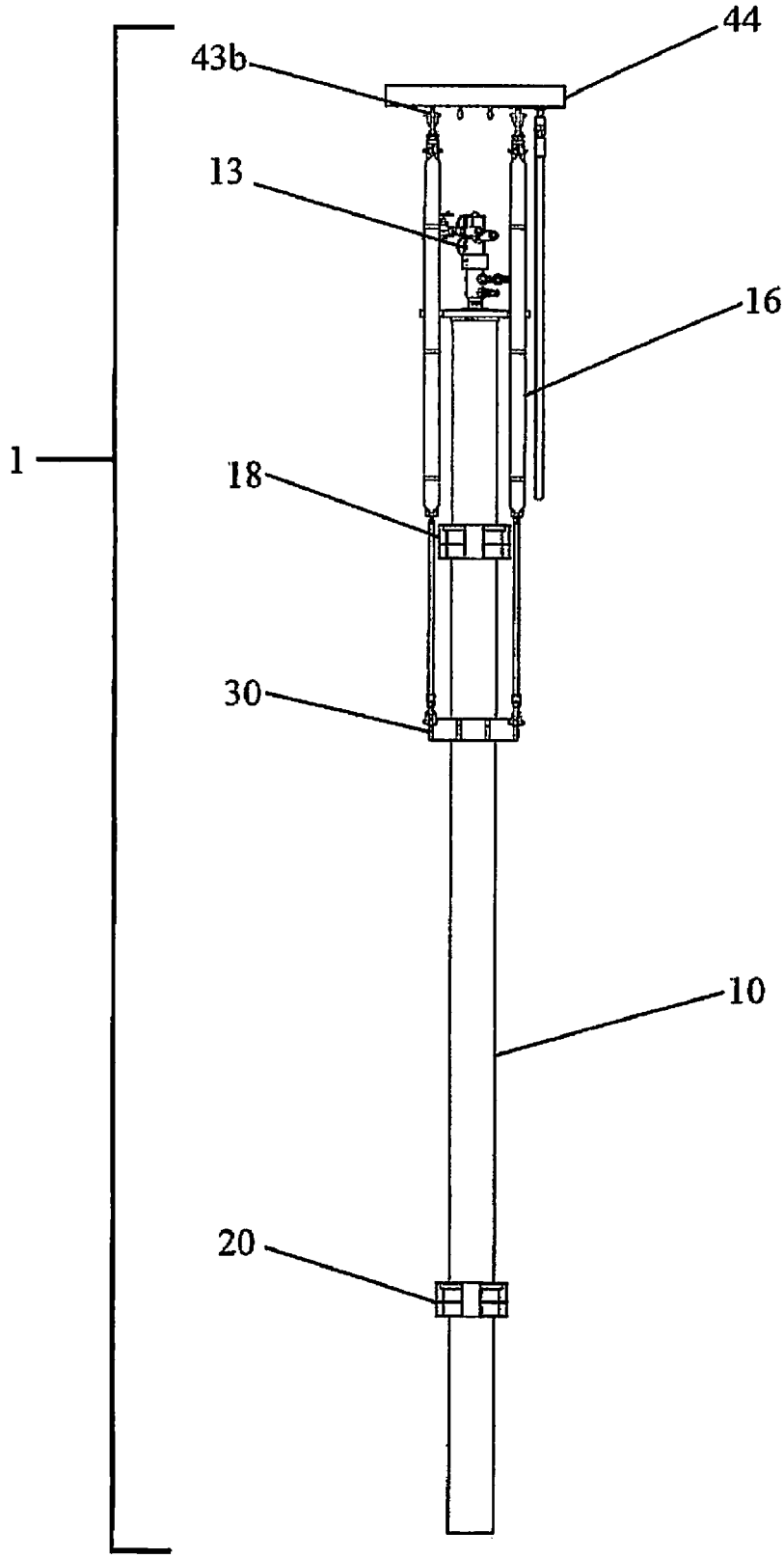
FIG. 2 depicts a side view of the tensioner assembly.
Figure 6:
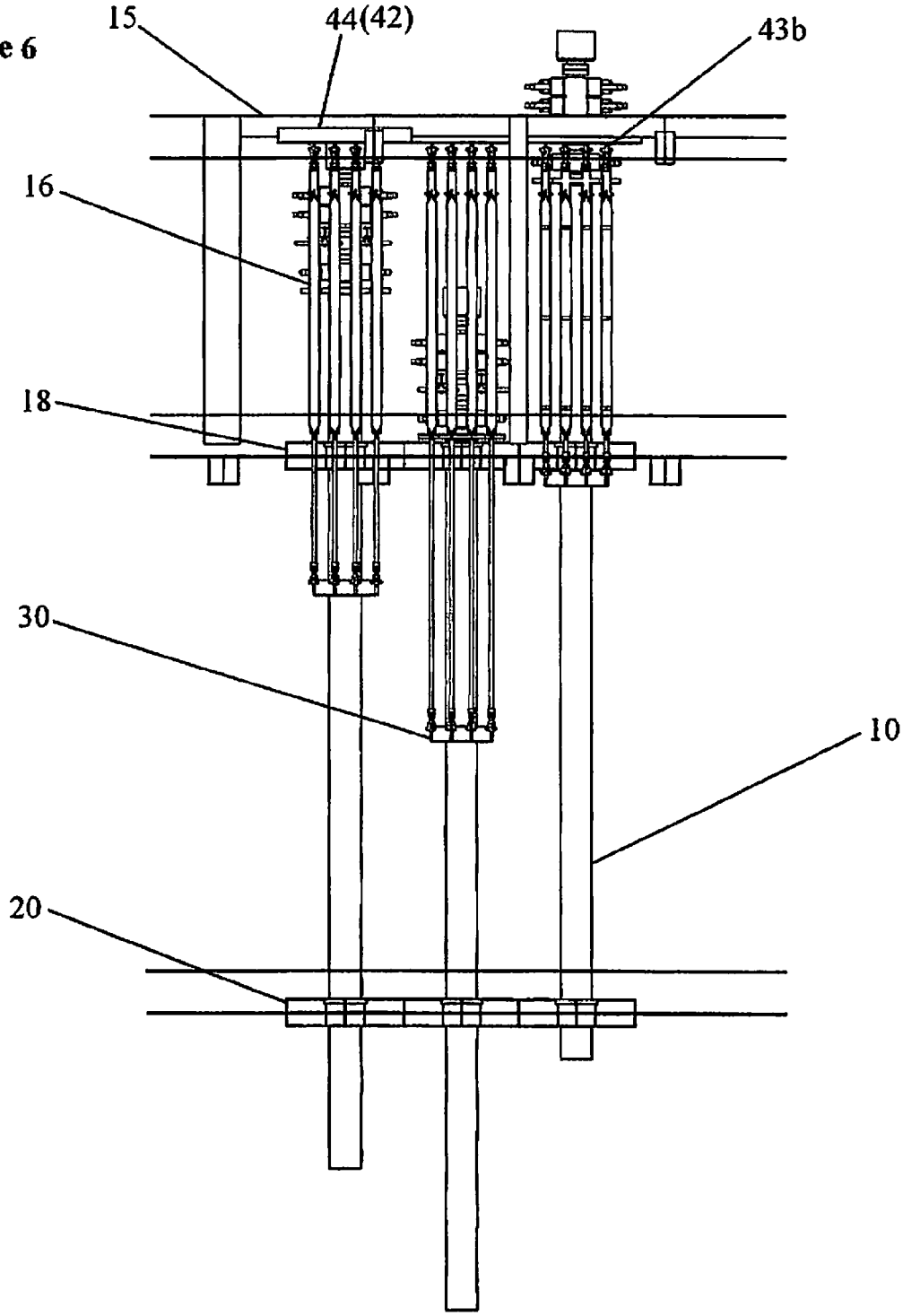
FIG. 6 depicts a side view of the tensioner assembly secured to a vessel.

Referring now to FIGS. 1, 2, and 6, the tensioner assembly 1 has a conductor 10. The conductor 10 can be a fifty four inch outside diameter steel pipe. A tension frame 30 is secured to the conductor 10 and at least one hydraulic cylinder 14. The hydraulic cylinder 14 is secured to a support frame 12. The support frame 12 is depicted having a first beam 42 parallel to a second beam 44. The first beam 42 and the second beam 44 can be connected to a rig 15. A first beam pad eye 43*a* is disposed on the first beam 42. A second beam pad eye 43*b* is disposed on the second beam 44.

A primary accumulator 16 is depicted in direct fluid communication with the hydraulic cylinder 14.

An upper conductor guide 18 and a lower conductor guide 20 slidably engage the conductor 10.

The tension frame 30 transfers tension from the hydraulic cylinder 14 to the conductor 10, then to a riser 32 and a piece of well access equipment 13, as depicted.

Figure 3:
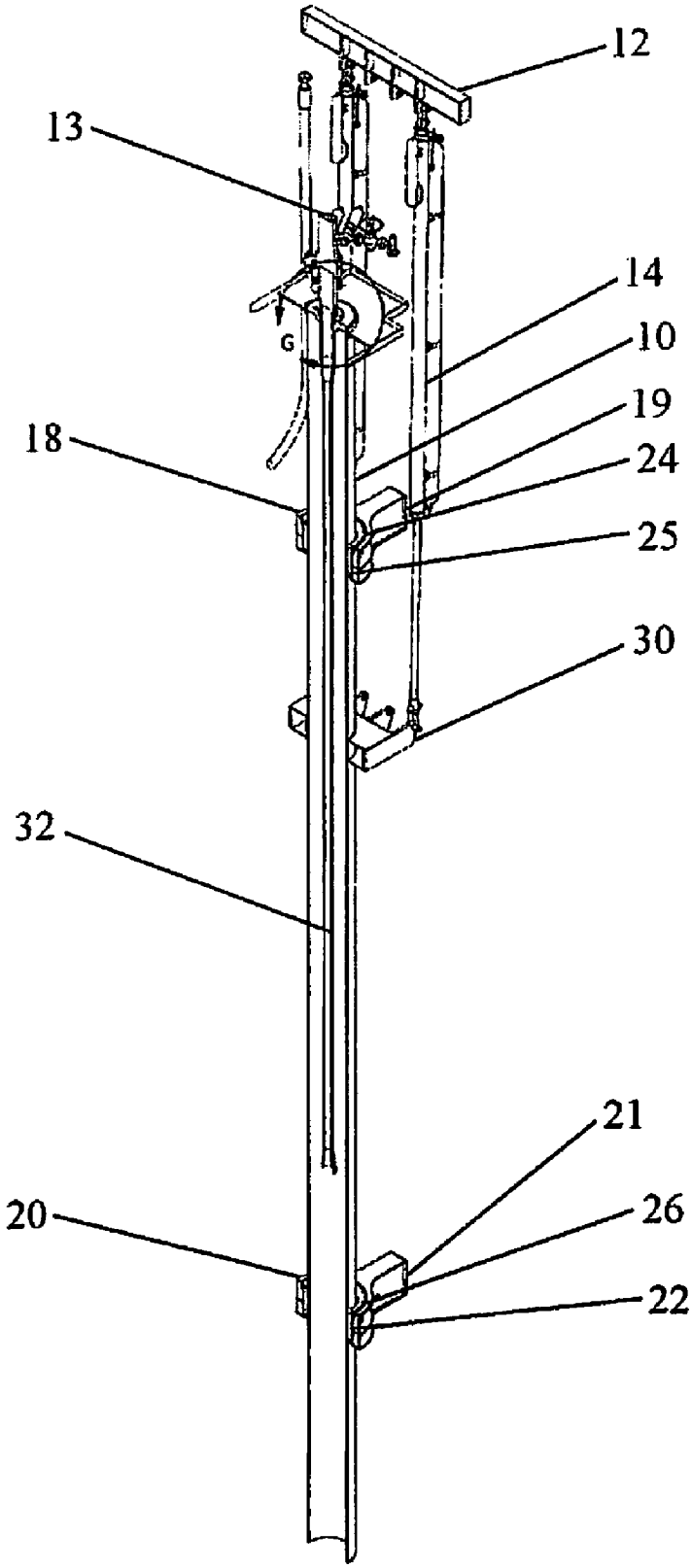
FIG. 3 is a cut view of the tensioner assembly.

FIG. 3 shows a cut view of the tensioner assembly 1. The well access equipment 13 is depicted secured to the conductor 10. The conductor 10 is secured to the well access equipment by a tension disc. The riser 32 extends through the center of the conductor 10. The hydraulic cylinder 14 is depicted secured to the tension frame 30 and the support frame 12.

The upper conductor guide retaining ring 24 is used to secure an upper conductor guide wear pad 25 to the upper conductor guide frame 19. The upper conductor guide ring 24, the upper conductor guide wear pad 25, and the upper conductor guide frame 19, form the upper conductor guide 18.

The lower conductor guide retaining ring 26 is used to secure a lower conductor guide wear pad 22 to the lower conductor guide frame 21. The lower conductor guide ring 26, the lower conductor guide wear pad 22, and the lower conductor guide frame 21, form the lower conductor guide 20.

Figure 4:
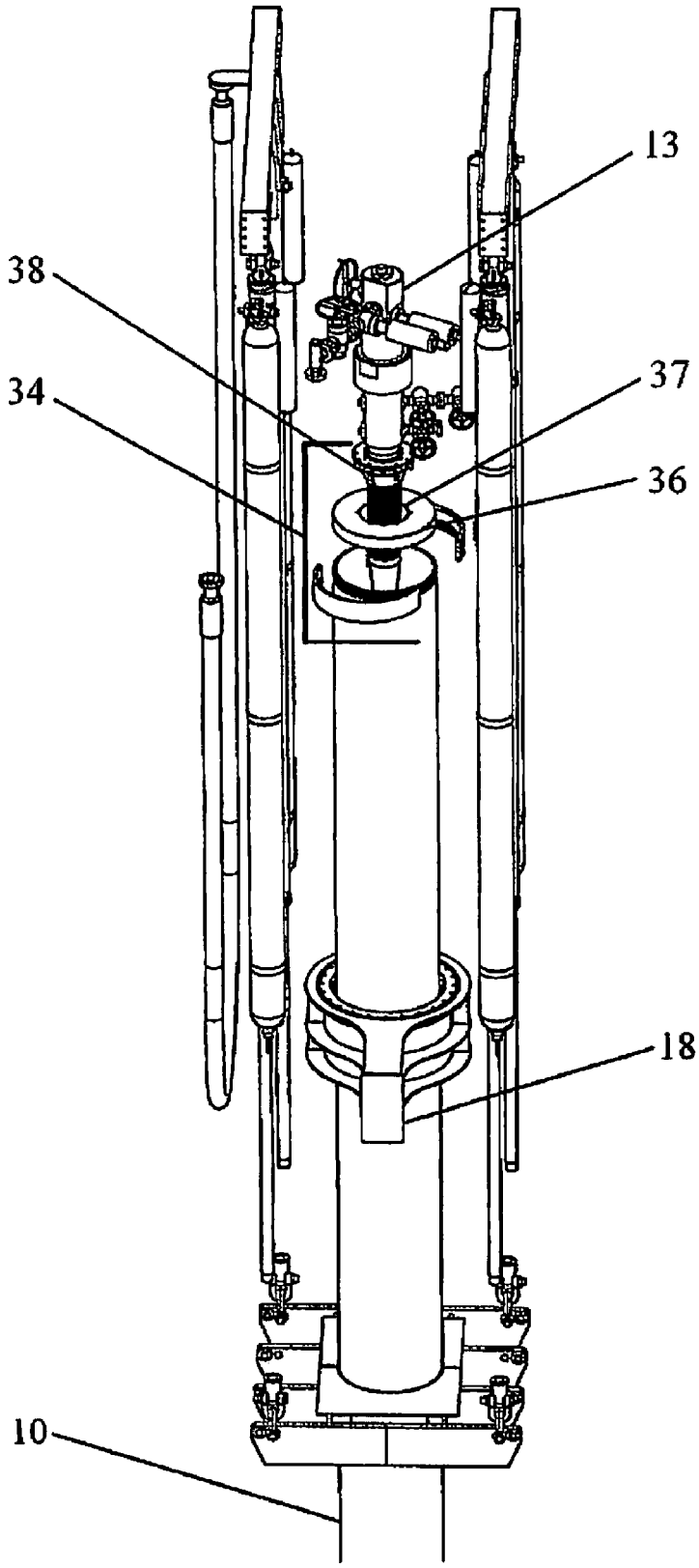
FIG. 4 is an exploded view of an embodiment of the tapered bowl tension ring assembly.
Figure 5:
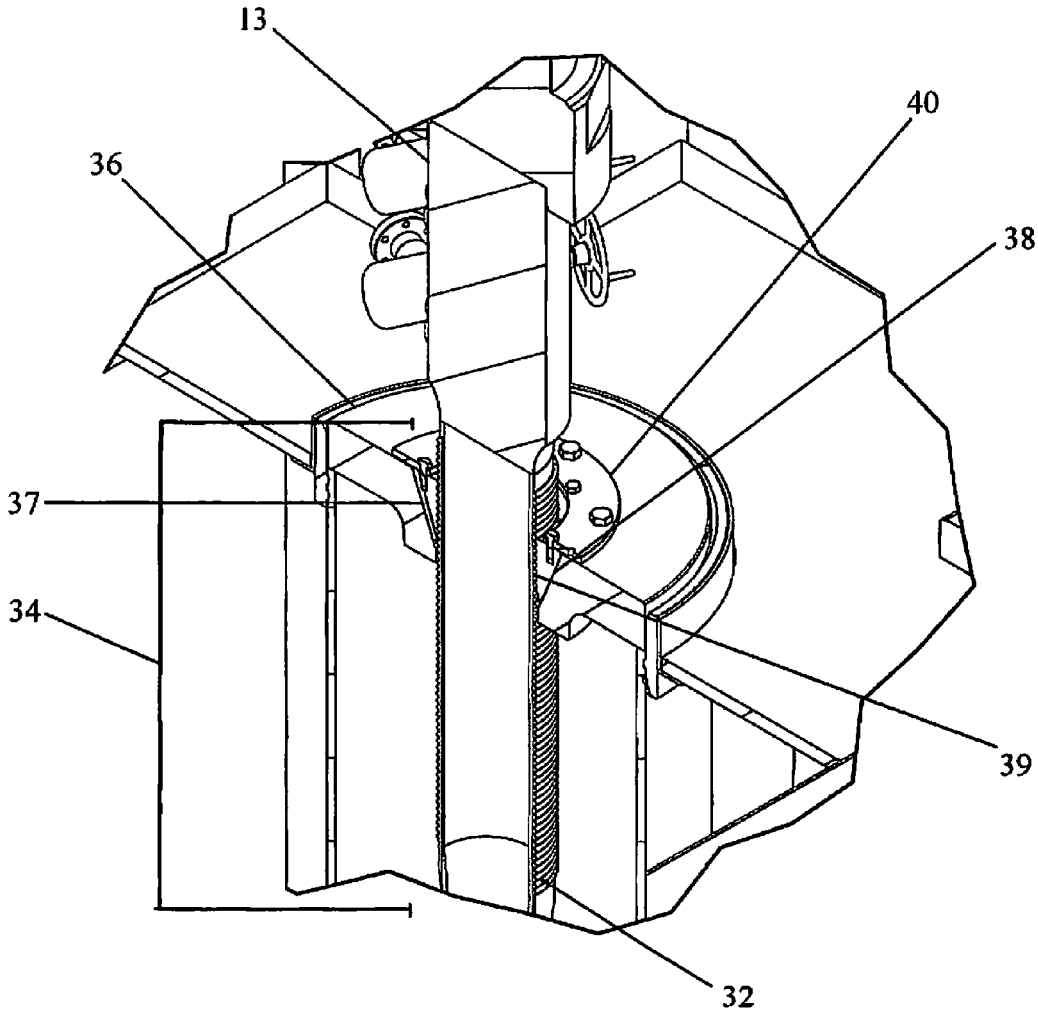
FIG. 5 is a cut view of an embodiment of the tapered bowl tension ring assembly.

Turning now to FIG. 4 and FIG. 5. A tapered bowl tension ring assembly 34 is depicted. The tapered bowl tension ring assembly 34 is disposed on the conductor 10 above the upper conductor guide 18.

The tapered bowl tension ring assembly 34 includes a tension disc 36. The tension disc 36 is depicted having a tapered center 37 for engaging the tapered collets 38. The tapered center 37 can be best seen in FIG. 5. The tapered center 37 can have a diameter for fitting commonly used riser diameters.

The tapered bowl assembly 34 has tapered collets 38 on threads 39. The threads 39 can be grooves. The threads 39 are for engaging the riser 32 in a secure connection. The tapered collets 38 engage the tension disc 36. A collet support ring 40 is disposed on the tapered collets 38 for supporting the tapered collets 38. The well access equipment 13 is depicted connected to the riser 32.

While these embodiments have been described with emphasis on the embodiments, it should be understood that within the scope of the appended claims, the embodiments might be practiced other than as specifically described herein.

What is claimed is:

1. A tensioner assembly for moveably carrying a conductor that supports a riser connected from a wellhead to a piece of well access equipment on a rig comprising:

a. a support frame;

b. at least one hydraulic cylinder connected to the support frame;

c. at least one primary accumulator in fluid communication with the at least one hydraulic cylinder;

d. an upper conductor guide and a lower conductor guide slidably contacting the conductor;

e. a tension frame secured to the conductor between the upper and the lower conductor guides for transferring tension from the at least one hydraulic cylinder to the conductor; and f. a tension ring assembly disposed on the conductor above the upper conductor guide.

2. The tensioner assembly of claim 1, wherein the support frame comprises:

a. a first beam connected to the rig and parallel to a second beam connected to the rig; wherein the first beam has a pad eye for supporting the at least one hydraulic cylinder, and wherein the second beam has another pad eye for supporting the at least one hydraulic cylinder.

3. The tensioner assembly of claim 1, wherein the support frame is a cassette frame.

4. The tensioner assembly of claim 1, wherein the upper and lower conductor guides each comprise a guide frame for supporting a conductor guide wear pad using a conductor guide retaining ring.

5. The tensioner assembly of claim 4, wherein the conductor guide wear pads comprise an ultra high molecular weight polymer, a metallic bearing material, a composite comprising a ceramic, glass, or combinations thereof.

6. The tensioner assembly of claim 1, wherein the tension frame is removably connected to the conductor.

7. The tensioner assembly of claim 1, wherein the tension ring assembly is a tapered bowl tension ring assembly comprising:

(i) a tension disc having a tapered center, wherein the tension disc supports the load from the riser to the conductor;

(ii) tapered collets for engaging the tapered center, wherein the tapered collets secure to the riser; and (iii) a collet support ring disposed on the tapered collets for supporting the tapered collets.

8. The tensioner assembly of claim 1, wherein the tension ring assembly comprises a single tension disc directly engaging the conductor, and supporting the riser.

9. A tensioner assembly for moveably carrying a conductor that supports a riser connected from a wellhead to a piece of well access equipment on a rig comprising:

a. a support frame;

b. at least one hydraulic cylinder connected to the support frame;

c. at least one primary accumulator in fluid communication with the at least one hydraulic cylinder;

d. an upper conductor guide and a lower conductor guide engaged with the conductor; wherein the upper and lower conductor guides each comprise a guide frame for supporting a conductor guide wear pad using a conductor guide retaining ring;

e. a tension frame secured to the conductor between the upper and the lower conductor guides; and f. a tension ring assembly disposed on the conductor above the upper conductor guide.

10. The tensioner assembly of claim 9, wherein the support frame comprises:

a. a first beam connected to the rig and parallel to a second beam connected to the rig; wherein the first beam has a pad eye for supporting the at least one hydraulic cylinder, and wherein the second beam has another pad eye for supporting the at least one hydraulic cylinder.

11. The tensioner assembly of claim 9, wherein the support frame is a cassette frame.

12. The tensioner assembly of claim 9, wherein the primary accumulator is connected to the hydraulic cylinder by a conduit, an umbilical, or a jumper.

13. The tensioner assembly of claim 9, wherein the conductor guide wear pads comprise an ultra high molecular weight polymer, a metallic bearing material, a composite comprising a ceramic, glass, or combinations thereof.

14. The tensioner assembly of claim 9, wherein the tension frame is removably connected to the conductor.

15. A tensioner assembly for moveably carrying a conductor that supports a riser connected from a wellhead to a piece of well access equipment on a rig comprising:

a. a support frame;

b. at least one hydraulic cylinder connected to the support frame;

c. at least one primary accumulator in fluid communication with the at least one hydraulic cylinder;

d. a first beam connected to the rig, wherein the first beam has a pad eye for supporting the at least one hydraulic cylinder;

e. a second beam connected to the rig parallel to the first beam, wherein the second beam has another pad eye for supporting the at least one hydraulic cylinder;

f. an upper conductor guide and a lower conductor guide disposed about the conductor;

g. a tension frame secured to the conductor between the upper and the lower conductor guides; and h. a tension ring assembly disposed on the conductor above the upper conductor guide.

16. The tensioner assembly of claim 15, wherein the primary accumulator is connected to the hydraulic cylinder by a conduit, an umbilical, or a jumper.

17. The tensioner assembly of claim 15, wherein the support frame is a cassette frame.

18. The tensioner assembly of claim 15, wherein the upper and lower conductor guides each comprise a guide frame for supporting a conductor guide wear pad using a conductor guide retaining ring.

19. The tensioner assembly of claim 18, wherein the conductor guide wear pads comprise an ultra high molecular weight polymer, a metallic bearing material, a composite comprising a ceramic, glass, or combinations thereof.

20. The tensioner assembly of claim 15, wherein the tension frame is removably connected to the conductor.

* * * * *